US006715750B1

(12) United States Patent
Gerlier et al.

(10) Patent No.: US 6,715,750 B1
(45) Date of Patent: Apr. 6, 2004

(54) FLEXIBLE MEDIA DISPENSER

(75) Inventors: Andre Gerlier, Sciez (FR); Roberto Polidoro, Geneva (CH); David Charles Deaville, West Chester, PA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/567,727

(22) Filed: May 10, 2000

(30) Foreign Application Priority Data

May 11, 1999 (GB) ..... 9910921

(51) Int. Cl.[7] ..... B65H 3/30
(52) U.S. Cl. ..... 271/21; 271/113
(58) Field of Search ..... 271/19, 21, 22, 271/24, 20, 113, 42

(56) References Cited

U.S. PATENT DOCUMENTS

| | | | | | |
|---|---|---|---|---|---|
| 902,751 | A | * | 11/1908 | Maegly | 271/21 |
| 3,425,685 | A | | 2/1969 | Liva | |
| 3,857,558 | A | | 12/1974 | Patel | |
| 3,893,663 | A | | 7/1975 | Sanchez et al. | |
| 3,944,215 | A | | 3/1976 | Beck | |
| 3,960,291 | A | * | 6/1976 | Navi | 271/42 |
| 4,189,138 | A | | 2/1980 | Kaneko et al. | |
| 4,223,884 | A | | 9/1980 | Burnham et al. | |
| 4,431,176 | A | | 2/1984 | Deconinck | |
| 4,918,463 | A | | 4/1990 | Piatt | |
| 4,981,235 | A | * | 1/1991 | Ferrini et al. | 271/24 |
| 5,181,708 | A | | 1/1993 | Ruch | |
| 5,195,735 | A | | 3/1993 | Sellers | |
| 5,273,267 | A | | 12/1993 | Neugebauer | |
| 5,314,178 | A | | 5/1994 | Cole, Jr. et al. | |
| 5,582,399 | A | | 12/1996 | Sugiura | |
| 5,664,786 | A | * | 9/1997 | Buschhaus et al. | 271/113 |

FOREIGN PATENT DOCUMENTS

| | | | | | |
|---|---|---|---|---|---|
| CH | 242174 | * | 4/1946 | | 271/21 |
| DE | 158 924 C | | 3/1905 | | |
| DE | 2065252 | * | 5/1980 | | 271/24 |
| EP | 0 345 989 A2 | | 12/1989 | | |
| EP | 0 508 040 A1 | | 10/1992 | | |
| EP | 0 595 524 A2 | | 5/1994 | | |
| FR | 1448296 | * | 6/1966 | | 271/21 |
| FR | 1 561 951 | | 4/1969 | | |
| GB | 210500 | * | 1/1924 | | 271/21 |
| GB | 1 397 379 | | 6/1975 | | |
| GB | 1 410 799 | | 10/1975 | | |
| GB | 2 133 391 A | | 7/1984 | | |
| GB | 2 176 465 A | | 12/1986 | | |
| JP | 0027841 | * | 2/1982 | | 271/21 |
| JP | 0082239 | * | 4/1988 | | 271/21 |
| SU | 1135520 | * | 1/1985 | | 271/21 |
| WO | WO 99/35619 | | 7/1999 | | |

* cited by examiner

*Primary Examiner*—Kenneth W. Noland
(74) *Attorney, Agent, or Firm*—Fish & Richardson P.C.

(57) ABSTRACT

A dispenser for dispensing flexible media such as cut sheets (1) from a stack has a rotatable separating member (4) which engages and reverse buckles one end of the top sheet (2) so that that end is lifted away from the stack and positioned between transport rollers (9, 10). The transport rollers (9, 10) are driven independently from the separating member (4) so that multiple sheets may be separated from the stack before being transported. The frictional engagement between the separating member (4) and the stack varies as the separating member rotates, so that only one sheet is separated with each rotation. The center of the top sheet (2) is held against the stack by a holding member (3) so that the top sheet buckles only over part of its length.

24 Claims, 8 Drawing Sheets

CROSS SECTIONAL VIEW

CROSS SECTIONAL VIEW

FLEXIBLE MEDIA DISPENSER

BACKGROUND OF THE INVENTION

The present invention relates to a flexible media dispenser, particularly but not exclusively for dispensing cut sheets.

Cut sheet dispensers are well known in many devices such as printers, scanners, fax machines, automated teller machines and the like. Typically such dispensers establish differential friction between some actuating mechanism and the first and subsequent sheets. The sheet to be dispensed is slid across the adjacent sheets. In practice there is always a risk that two or more sheets will be accidentally dispensed. Much prior art focuses on detecting and correcting such anomalies.

On the other hand, attempts have been made to design mechanisms which reduce the likelihood of dispensing two sheets from the outset. One such type of mechanism is the 'reverse buckle' mechanism in which one end of the top sheet is initially driven towards its center so that the top sheet buckles. The buckled portion of the top sheet lifts away from the rest of the stack so as to facilitate removal of the top sheet. In some of these 'reverse buckle' mechanisms, the reverse driving causes one end of the top sheet to be lifted over a retaining member, so that the end can be engaged by a transport mechanism and the sheet can be dispensed. Examples of reverse buckle sheet feeders are given in GB 1 397 379 (Brooke), GB 1 410 799 (Xerox), U.S. Pat. No. 3,857,558 (Patel/Xerox), U.S. Pat. No. 3,893,663 (Sanchez/Xerox), U.S. Pat. No. 3,944,215 (Beck/Pitney Bowes), U.S. Pat. No. 4,189,138 (Kaneko/Xerox), U.S. Pat. No. 4,223,884 (Burnham/Kodak), U.S. Pat. No. 5,181,708 (Ruch/Compaq) and U.S. Pat. No. 5,195,735 (Sellers/Compaq).

The document GB 2 176 465 A (Alois Zettler) discloses a device for drawing off sheets from a sheet stack by frictionally engaging one end of the top sheet with a lower take-off roller and driving that end in the opposite direction to the final take-off direction. Unlike the reverse buckle mechanisms described above, the lower take-off roller continues to rotate in the same direction so that the end of the top sheet is lifted over the top of the lower take-off roller and is grasped by an upper take-off roller. However, it is necessary in this device to halt the lower take-off roller while a sheet is being dispensed by the upper take-off roller, so that only one sheet is dispensed at a time. The device achieves this with an arrangement of circumferential grooves in the upper and lower rollers, in which control dogs are located, so that the outer sheet is transported by engagement between the upper roller and the control dogs. The circumferential grooves and control dogs give the sheet a 'serpentine' or corrugated form, so that the device is limited to applications where protection of the sheet is not important, such as shredders.

SUMMARY OF THE INVENTION

According to a first aspect of the present invention, there is provided an apparatus or method for dispensing a outer sheet from a stack of sheets, in which the outer sheet is engaged by a rotatable member arranged so that the frictional force between the rotatable member and the stack varies as the rotatable member rotates, such that the rotatable member engages the outer sheet with a high frictional force so as to lift an end of the outer sheet away from the stack so that the rotatable member lies between the end of the outer sheet and the stack, while contacting the subsequent outer sheet with a low frictional force, or not contacting the subsequent outer sheet at all. An advantage of this arrangement is that lifting of the subsequent outer sheet at the same time as the current outer sheet is avoided.

According to a second aspect of the present invention, there is provided an apparatus or method for dispensing a outer sheet from a stack of sheets, in which one end of the outer sheet is buckled away from the stack by a rotating member until the rotating member lies between the outer sheet and the stack, and the outer sheet is then gripped between a pair of rollers, one of which may be part of the rotating member or substantially coaxial with the rotating member, while being removed from the stack. This arrangement contrasts with that of GB 2 176 465 (Alois Zettler), in which the outer sheet is grasped between an upper take-off roller and a counter-pressure device, but cannot be driven between the upper and lower take-off rollers because the lower take-off roller must be kept stationary to avoid separating another sheet from the stack while the outer sheet is still being removed. Thus, the 'serpentine' creasing of the sheets can be avoided by this aspect of the present invention.

According to a third aspect of the present invention, there is provided an apparatus or method for dispensing a outer sheet from a stack of sheets, in which the outer sheet is held at a first point against the stack with a variable frictional force and an end of the outer sheet is driven, at a second point, towards the first point so as to cause the outer sheet to buckle away from the stack, before being removed from the stack.

The variable frictional force is varied so that, during the buckling step, the frictional force is high so as to hold the outer sheet securely while it is buckled, while during the removing step, the frictional force is low so as to facilitate removal of the sheet.

According to a fourth aspect of the present invention, there is provided an apparatus and method for dispensing an outer sheet from a stack of sheets, in which an end of the outer sheet is engaged by at least part of a roller located adjacent the stack in a first position of the roller, so as to separate the end from the stack and locate the end in a space between the roller and a surface, and in a second position of the roller, the end is gripped between the roller and the surface so that the outer sheet may be removed from the stack. In its first position, the roller may be driven so as successively to separate a plurality of sheets from the stack and locate each of their ends together between the roller and the surface, before removing the plurality of sheets from the stack in the second position of the roller.

According to a fifth aspect of the present invention, there is provided an apparatus and method for dispensing a outer sheet from a stack of sheets, in which a separating member separates one end of the outer sheet from the stack, so that the separating member lies between the outer sheet and the stack, and subsequently moves towards the opposite end of the outer sheet so as to separate an intermediate portion of the outer sheet from the stack. Advantageously, this reduces the contact area between the outer sheet and the rest of the stack when the outer sheet is subsequently removed from the stack.

According to a sixth aspect of the present invention, there is provided an apparatus or method for dispensing a outer sheet from a stack of sheets, in which the outer sheet is held at an intermediate point against the stack while one end of the outer sheet is buckled away from the stack by a rotating member until the rotating member lies between the outer sheet and the rest of the stack, and the outer sheet is then removed from the stack. An advantage of holding the middle of the outer sheet against the stack during the buckling operation is that the extent of buckling of the outer sheet can be controlled so as reliably to achieve the movement of the end of the outer sheet over the rotating member.

BRIEF DESCRIPTION OF THE DRAWINGS

Specific embodiments of the present invention will now be described with reference to the accompanying drawings, in which.

DETAILED DESCRIPTION OF THE PREFERRED EMBODIMENTS

Figure 1:
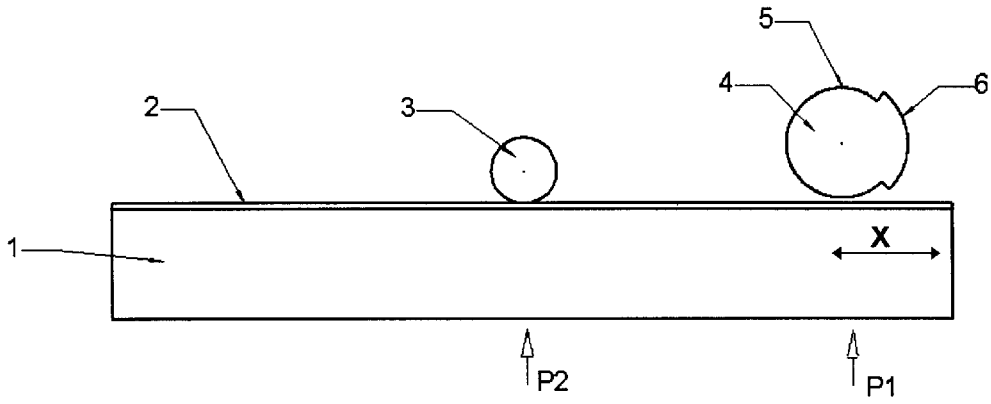
FIG. 1 shows the functional elements of a sheet separation mechanism in a first embodiment of the invention.

FIG. 1 shows the mechanism of the first embodiment at rest in its initial condition. A stack of sheets 1 to be dispensed, for example banknotes, contacts a rotatable separating member 4 and a rotatable holding member 3 with first and second forces P1 and P2 respectively. These forces may arise from a uniform or variable pressure exerted on the sheets by a mechanism which is not shown, for clarity. Such a mechanism may be readily contrived using elastic elements, gravity, solenoids, motors, pneumatics, hydraulics or the like, or a combination of these methods. For example, the mechanism may comprise a plate on which the sheets 1 rest, spring-biased towards the separating members 3,4. The separating member 4 has at least first and second distinct surface regions, indicated as 5 and 6 in FIG. 1. The second surface region 6 has a high co-efficient of friction against the adjacent surface of a top sheet 2. The first surface region 5, by contrast, is chosen to have a minimal co-efficient of friction against the top sheet 2 to be dispensed. To augment the difference in friction between these surfaces, in this embodiment the second surface region 6 is located on a portion of the separating member 4 having a larger radius than the portion on which first surface region 5 is located. This causes a different value of the first force P1 at different stages of rotation of the separating member 4. In this embodiment, the first surface region 5 does not contact the top sheet 2 at all, so that the first force P1 is zero when the second surface region 6 is not in contact with the top sheet 2.

The separating member 4 is situated at a distance X in a direction parallel to the top sheet 2 from the edge of the stack of sheets 1, as shown in FIG. 1. The distance X is chosen to be approximately equal to the arc length of the second surface region 6.

Figure 1A:
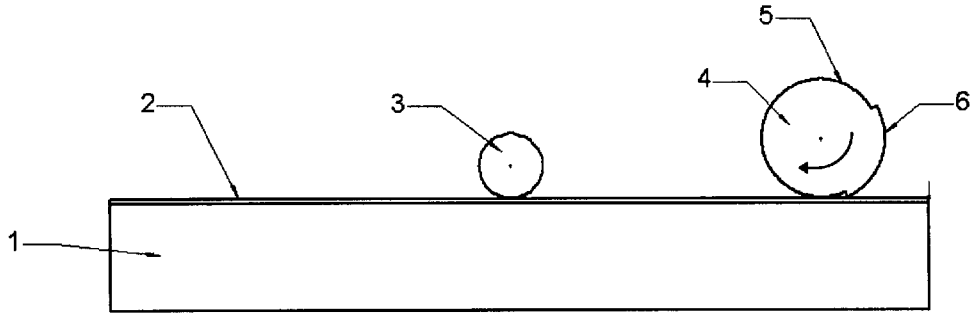
FIGS. 1A through 1G show an operational sequence of the mechanism of FIG. 1 leading to separation of one sheet from a stack.

FIGS. 1A through 1E show the sequence of events during one complete cycle of the mechanism. In FIG. 1A the rotatable separating member 4 has begun to rotate in the direction indicated by the arrow. The second surface region 6 has just come into contact with the top sheet 2 to be dispensed. The holding member 3 is static.

Figure 1B:
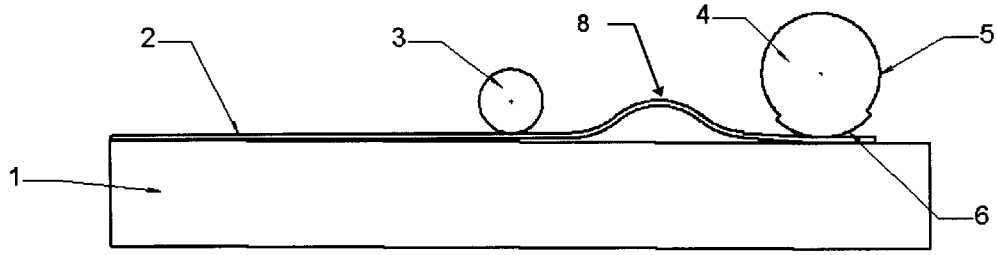
Figure 1C:
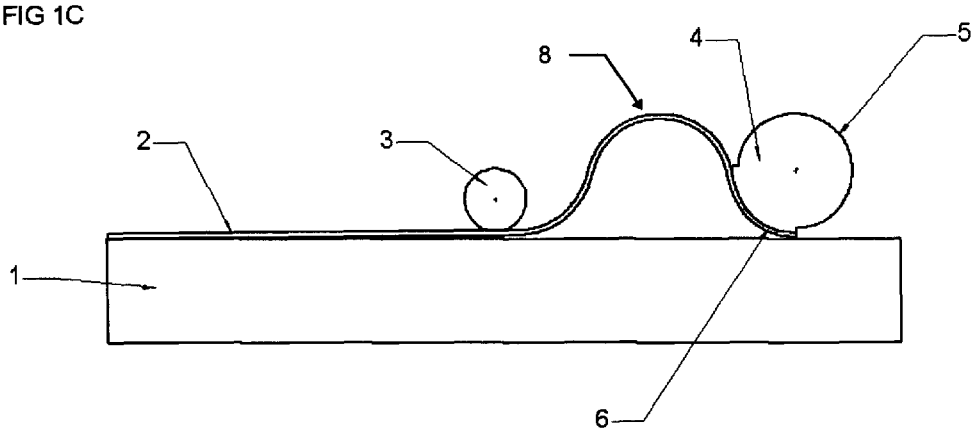

In FIG. 1B the right end of the top sheet 2 has begun to move under friction with the second surface region 6 whose co-efficient of friction against the top sheet 2 is greater than the co-efficient of friction between the top sheet 2 and adjacent sheets 1. Since the left side of the sheet is static and constrained by the holding member 3 and/or the walls of the stack container (not shown) the top sheet 2 begins to buckle away from the other sheets 1 in a buckle region 8. The effect of this buckling is to separate the buckle region 8 of the top sheet 2 from the stack, further reducing the frictional forces on the subsequent sheets 1. In FIG. 1C this separation process has progressed further. The buckle region 8 of the top sheet 2 increases in extent over the right hand side of the top sheet 2, which now offers little lateral resistance to the motion of the separating member 4.

Figure 1D:
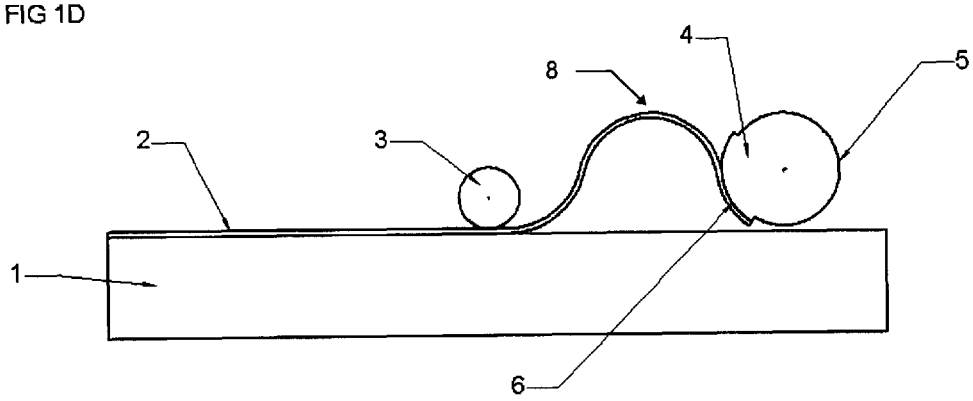

FIG. 1D shows that, as the right hand edge of the top sheet 2 is lifted from the stack of sheets, this edge is approximately aligned with the edge of the second surface region 6. This effect is achieved by appropriate selection of the location of the separating member 4 and the circumferential extent of the second surface region 6.

Figure 1E:
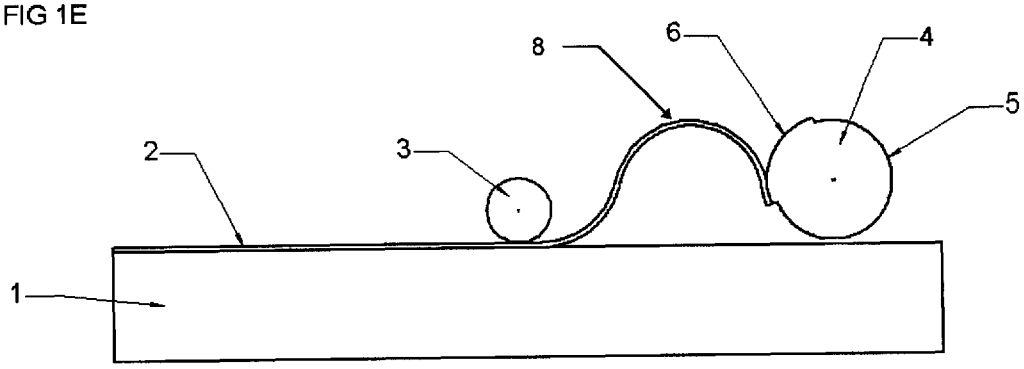

FIG. 1E shows that the top sheet 2 to be dispensed continues to deform as the separating member 4 rotates. The right end of the top sheet 2 rises as it follows the periphery of the separating member 4, still in contact with the second surface region 6. The top of the stack of sheets 1 is now in contact only with the first surface region 5 of the separating member 4 or is not in contact with the separating member 4 at all. The separating member 4 thus rotates freely over the face of the stack of sheets 1 without engaging them. Arranging that the radius of the first surface portion 5 is less than that of the second surface portion 6 further enhances the free sliding of the separating member 4 on the stack of sheets 1 from this point onwards in the cycle.

Figure 1F:
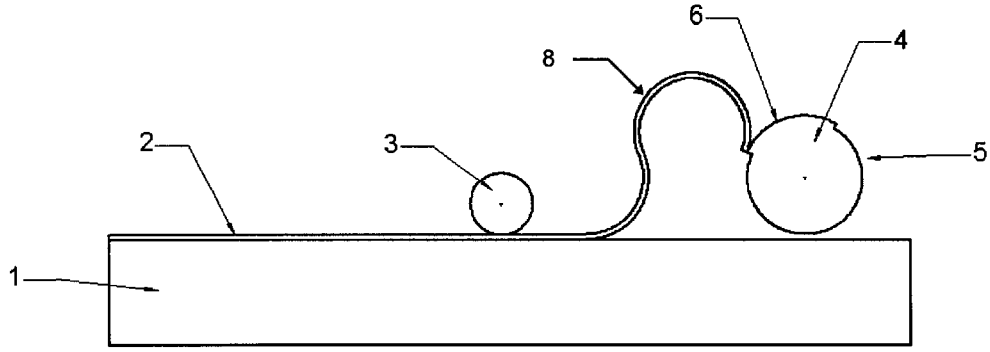
Figure 1G:
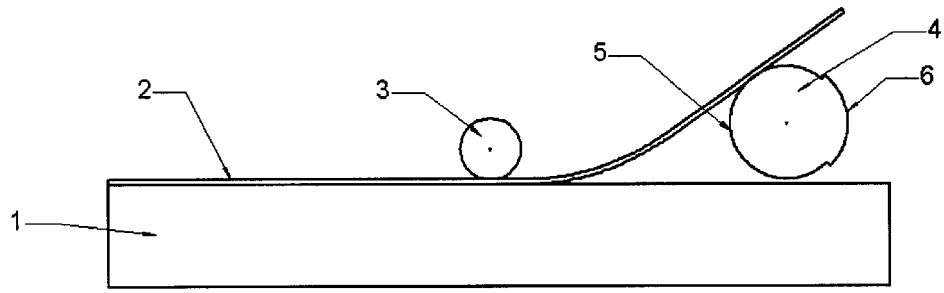

At a later point, shown in FIG. 1F, the right hand edge of the top sheet 2 rises above the center of the separating member 4 and the top sheet 2 snaps to a new stable position resting below the holding member 3 but on top of the separating member 4, as shown in FIG. 1G.

Figure 2:
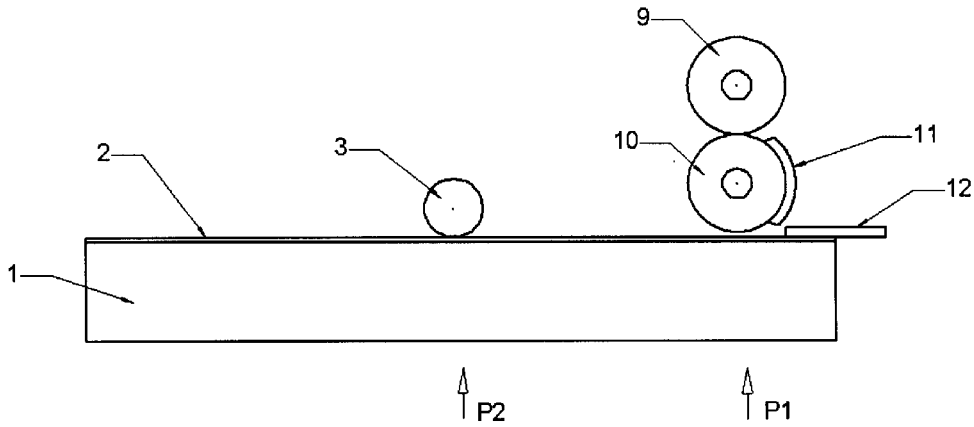
FIG. 2 shows the sheet separator of FIG. 1 integrated with a simple transport mechanism to complete the extraction of the separated sheet.
Figure 3:
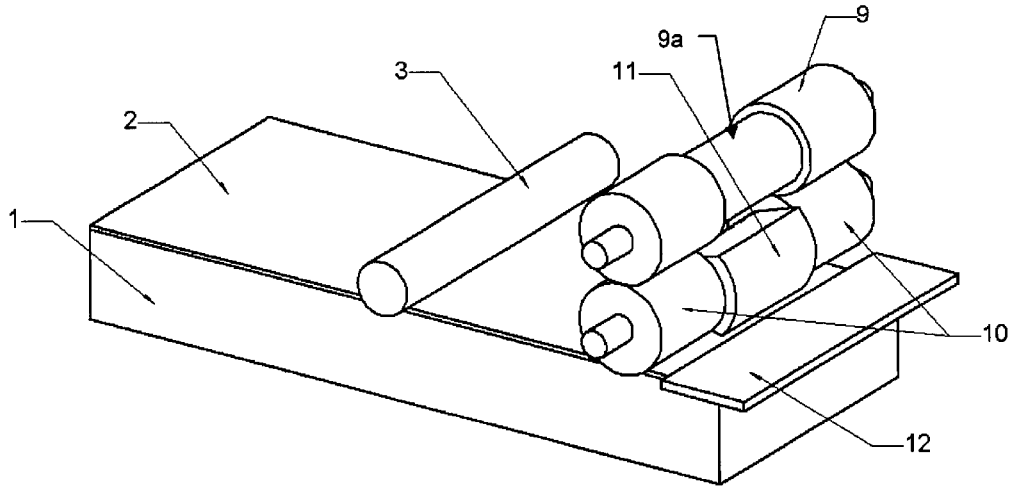
FIG. 3 shows an isometric view of the mechanism of FIG. 2.

FIGS. 2 and 3 show how the basic separation mechanism in FIG. 1 can be combined with a simple transport mechanism to produce a complete dispenser module. Many of the elements of FIG. 1 are present, and the same reference numerals are used for these, but a rotatable first transport member 9 has been added and the separating member 4 has been replaced by two discrete components: a rotatable second transport member 10 and an independently rotatable separating cam 11 with a radially outer surface having a high coefficient of friction. The first transport member 9 has a circumferential groove 9*a* along part of its axis to provide clearance for the complete rotation of the cam 11. Alternatively the first transport member 9 could be made from a soft resilient material. In another alternative, elastic devices such as springs may control the distance between the axes of the cam 11 and the first transport member 9. In yet another variant the cam 11 may be of deformable construction or it may rotate about a different center to that of the second transport member 10. A plurality of the above methods may be used in combination.

The cam 11 is connected so as to be driveable independently of the second transport member 10. For example, the cam 11 may be mounted on an axle driven by a stepper motor, the rotation of which is controlled by a microcontroller. The second transport member 10 may be freely rotatable about the axle, and driveable by engagement with the first transport member 9, which is itself driven by a further stepper motor, also controlled by the microcontroller. Alternative driving arrangements may be envisaged by the skilled person.

During the first revolution of the dispense cycle, the cam 11 is rotated in unison with the transport members 9, 10. After completion of its first revolution, the cam 11 ceases to rotate and remains static, while the transport members 9 and 10 continue to rotate. The frictional force generated between the top sheet 2 and the first and second transport members 9 and 10 drags the left hand side of the top sheet 2 over the surface of the stack. To facilitate this motion, the holding member 3 may also be rotated by a driving mechanism or may rotate freely. Alternatively the holding member 3 may be a fixed element with a low friction surface. If required for constraining the stack of sheets 1, multiple holding members 3 may be deployed.

In any of the above cases the normal second force P2 between the holding member 3 and the top sheet 2 is desirably quite small, or even zero, during the stage in which the top sheet 2 is removed. Since the first force P1 is important during the phase when the second force P2 is not and vice versa, both these forces P1 and P2 may be modulated approximately together by varying the force on the whole stack during the dispense cycle. For example, the stack of sheets 1 may be supported on a plate to which a varying force is applied during the cycle.

FIGS. 2 and 3 show how the first force P1 may vary during the rotation of the cam 11. At rest the first force P1 is constrained against a surface of a plate 12 fixed with respect to a housing or frame of the device. As the cam 11 is rotated it pushes against the surface of the top sheet 2 and all or part of the first force P1 is available to generate a frictional drive during a portion of the rotation while the cam 11 engages the top sheet 2.

The fixed surface of plate 12 may also be positioned so that the surface of the second transport member 10 is slightly separated from the surface of the top sheet 2. In this case the coefficient of friction of the second transport member 10 may be selected solely for the purpose of providing good sheet transport without regard to the friction against the top sheet 2 when on the stack 1.

In another variant the surface of the plate 12 against which the first force P1 acts is not fixed but moves during the dispense cycle so as to modulate the effect of the first force P1 as required. The surface may have a convex or concave form, or be flat. Further the first force P1 may be modified by an external apparatus (not shown) during the course of a dispense cycle.

In order to simplify the control algorithms it is also possible to keep the transport members 9, 10 stationary while cam 11 makes an initial rotation of approximately 360 degrees. Thereafter the drive for cam 11 is turned off and the drive for the transport members 9 and 10 is turned on to complete the transport of the top sheet 2 from the stack.

In another variant it is possible to dispense more than one sheet at the same time. To accomplish this, the cam 11 is rotated approximately n times, where n equals the number of sheets to be dispensed. Each complete rotation of the cam 11 separates the end of one sheet from the stack and positions that end between the first and second transport members 9 and 10. The transport members 9 and 10 are held static until the cam 11 has finished its rotations, and are then rotated to transport multiple sheets in one operation.

In this instance the cam 11 has been drawn as a non-circular element; however it should be understood that it could also be a cylinder with a discrete high friction surface region corresponding to the second surface region 6 on the separating member 4 of FIG. 1. For convenience the second transport member 10 and the cam 11 operate on approximately the same center axis. In other embodiments they may be of different radius and operate on separate axles. The number and axial arrangement of the transport members 9 and 10 and the cam 11 may be varied without departing from the scope of the invention.

Figure 4:
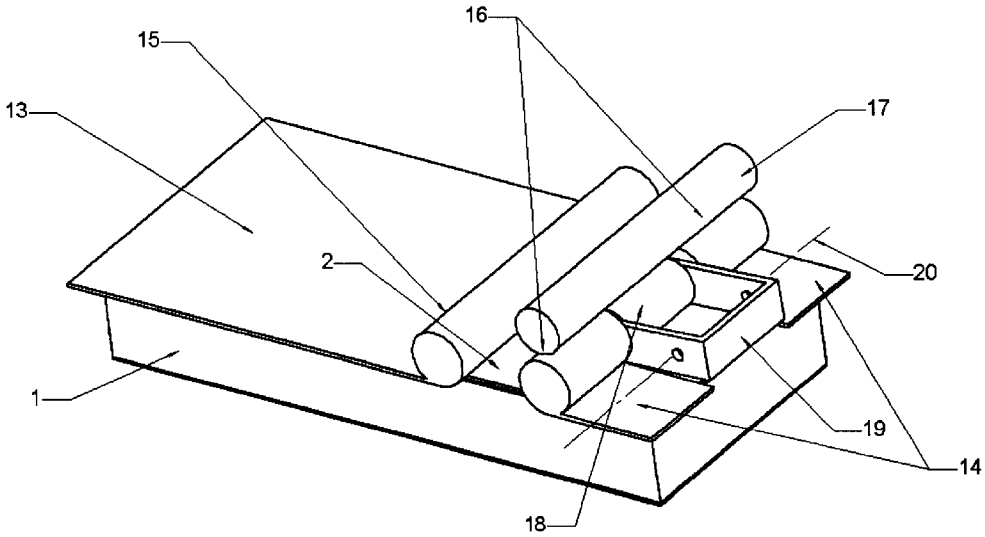
FIG. 4 shows a second embodiment where the rotating members are additionally capable of a traversing motion and the media stack is restrained by flexible membranes.

FIG. 4 shows an isometric view of a mechanism according to a second embodiment of this invention, which is capable of both dispensing and stacking flexible sheets. The stacking method is as disclosed in U.S. Provisional Application Ser. No. 60/070723, and will not be described further herein.

The relevant features which allow stacking are a rotatable first holding member 15 to which is attached a first resiliently flexible membrane 13. The first holding member 15 is moveable in a direction parallel to the longitudinal axis of the stack of sheets 1, and is rotated as it moves so that the first flexible membrane 13 is wrapped or unwrapped around the first holding member 15 as the first holding member 15 moves respectively towards or away from the free end of the first flexible membrane 13. The first flexible membrane 13 is resilient so as to maintain contact with the top sheet 2. These elements replace the function of the holding member 3 in FIGS. 1, 2 & 3.

A pair of rotatable second holding members 16 are shown attached to corresponding second resiliently flexible membranes 14. A rotatable separating member 18 is shown attached to a bracket 19 which is capable of pivoting about an axis parallel to the plane of the top sheet 2 so as to engage the top sheet 2, in a lower position, or a rotatable transport member 17, in an upper position. The second holding members 16 are movable with the first holding member 15 in a direction parallel to the longitudinal axes of the sheets 1, and rotate as they do so, so as to unwrap or wrap the second membranes 14 as the second holding members 16 move respectively away from or towards the free ends of the second membranes 14, which are kept in contact with the top sheet 2 by their resilience.

A suitable driving mechanism is provided so as to traverse the first and second holding members 15 and 16 and the rotatable transport member 17 parallel to the stack, and to rotate the first and second holding members 15 and 16 as they traverse. For example, the first and second holding members 15 and 16 may be mounted on axles, on either end of each of which is mounted a pinion moveable along a rack extending alongside the stack, so as to rotate the axles as they traverse. The traversing motion may be applied to the axles by a reciprocating rod or belt driven by a motor, the actuation of which is controlled by a microcontroller. The pivoting of the bracket 19 may be actuated by a further motor, or piston, also controlled by the microcontroller so as to synchronize the stages of the dispense cycle. Alternative driving methods may be envisaged by the skilled person.

It should be understood that many variants of the geometry of this mechanism are possible, where for example the holding members 16 are combined in a single unit or split into more than two units.

Figure 4A:
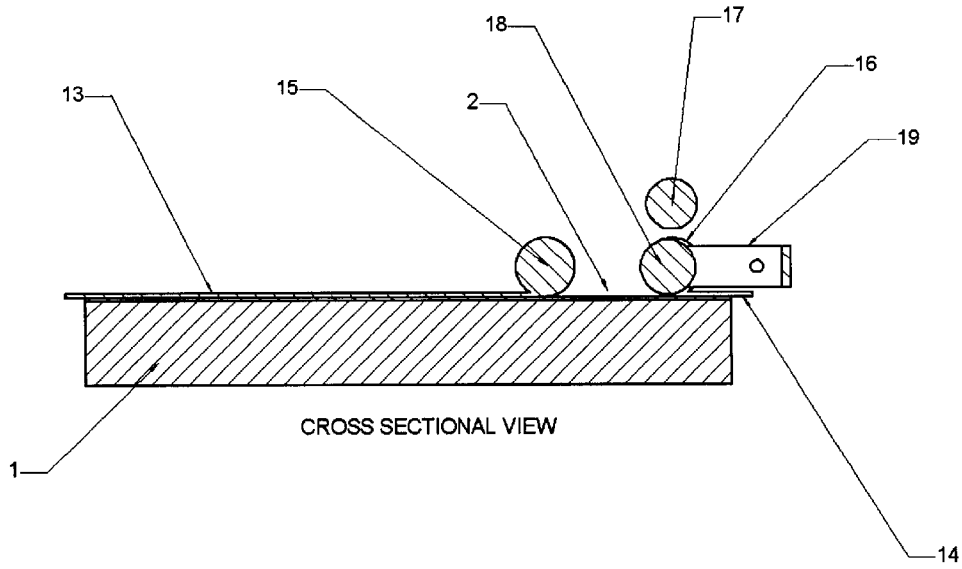
FIGS. 4A through 4F show a sequence of operations of the second embodiment during a dispense cycle.

FIG. 4A shows a longitudinal cross-section of the mechanism of the second embodiment at rest, while FIGS. 4B to 4F show the same cross-section of the mechanism in different stages of a dispense cycle. In FIG. 4A, the separating member 18 is in an intermediate position not in contact with either the top sheet 2 to be dispensed or the transport member 17.

Figure 4B:
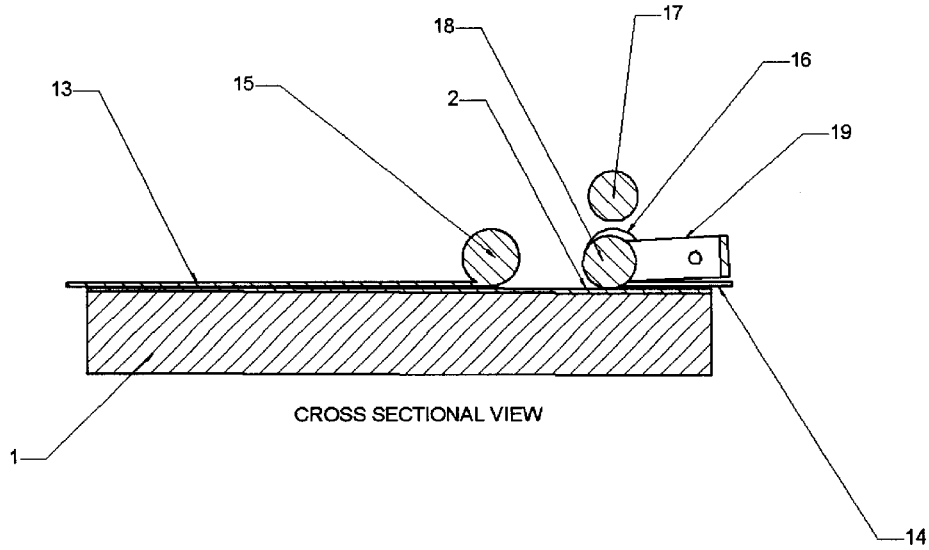

FIG. 4B shows the apparatus at the start of a dispense cycle. The bracket 19 has been rotated to bring the separating member 18 into frictional contact with the top sheet 2 to be dispensed.

Figure 4C:
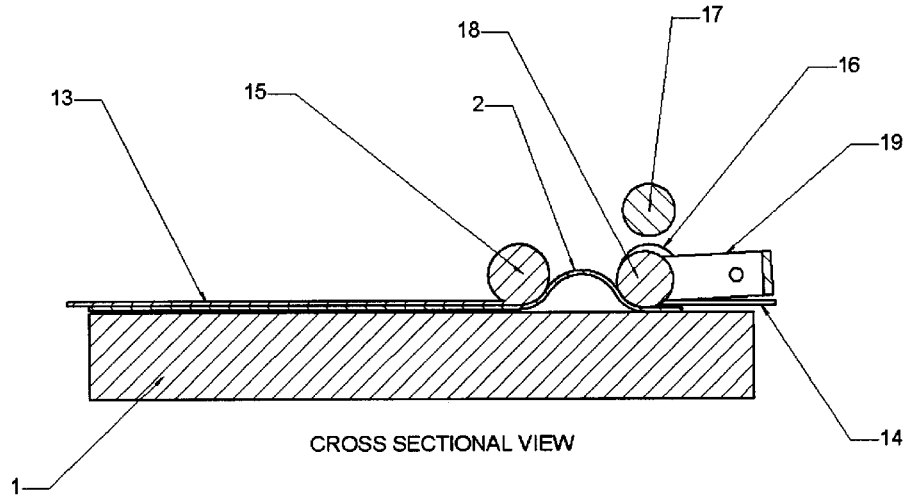

FIG. 4C shows the position of the top sheet 2 after the separating member 18 has started to rotate clockwise as seen in the cross-sectional view, causing the right hand side of the top sheet 2 to move towards its center and to buckle upwards.

Figure 4D:
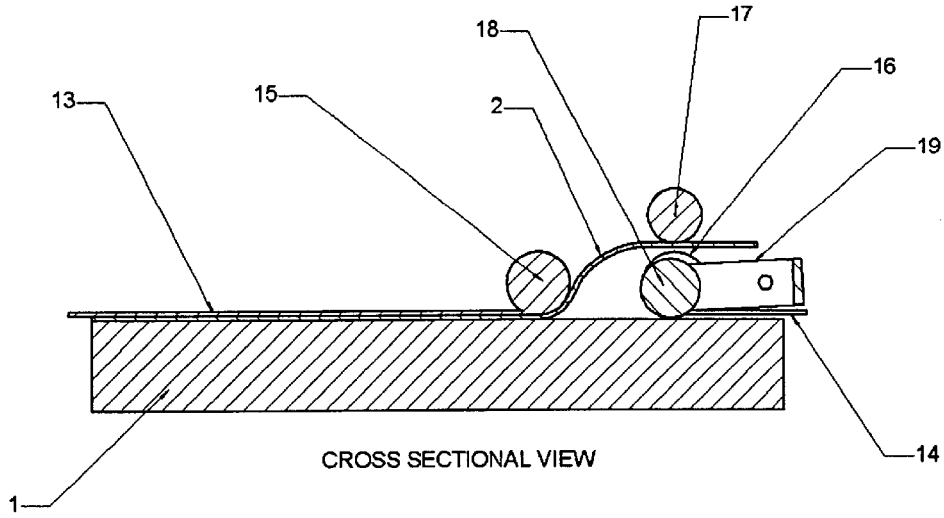

FIG. 4D shows that the right hand end of the top sheet 2 is now completely separated from the stack of sheets 1 and is resting on top of the second holding members 16.

Figure 4E:
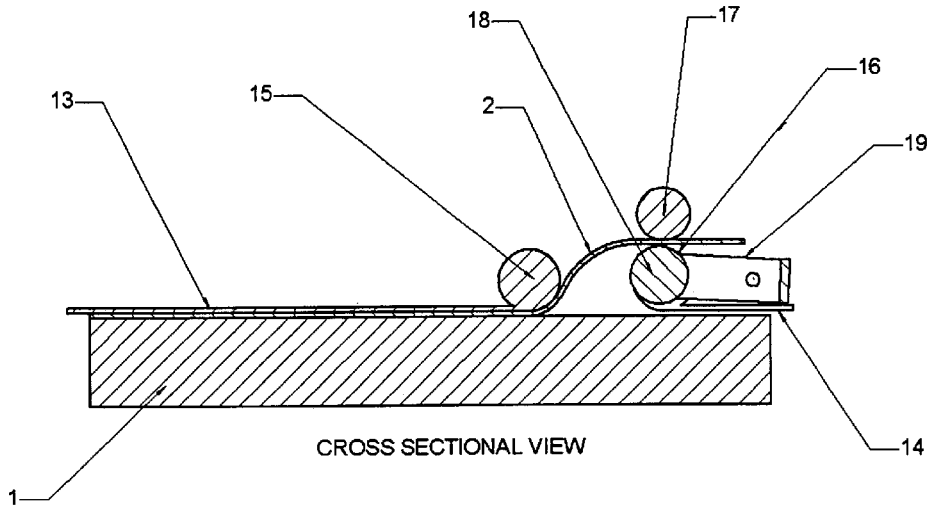

FIG. 4E shows that the bracket 19 has lifted the separating member 18 away from the top surface of the stack of sheets 1, so as to grip the top sheet 2 between the separating member 18 and the transport member 17.

Figure 4F:
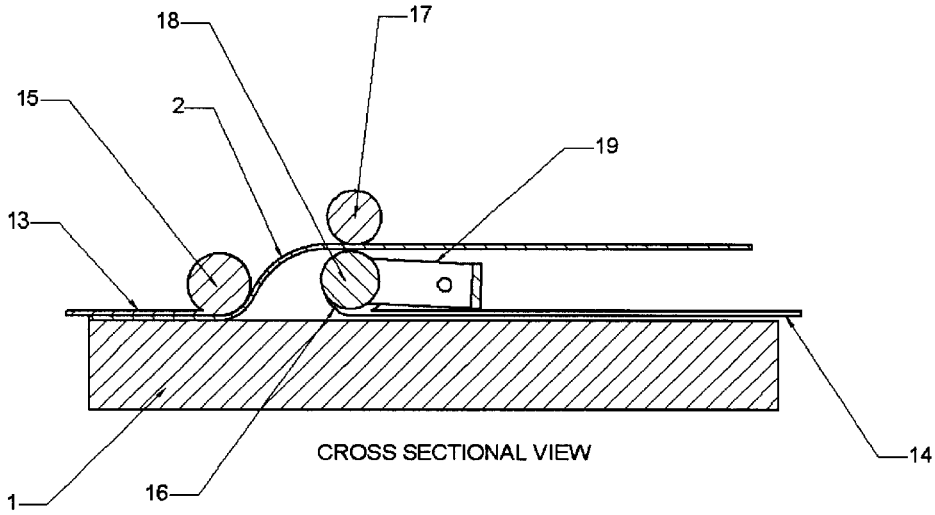

FIG. 4F shows that the mechanism has commenced to traverse the surface of the stack of sheets 1. As the mechanism traverses, the first and second holding members 15 and 16 rotate so as to respectively wrap and unwrap the first and second membranes 13 and 14 about themselves. Meanwhile the separating member 18 is rotated in a reverse sense to the second holding members 16 to assist the separation of the top sheet 2 from the stack of sheets 1. The top sheet 2 is then driven away from the stack of sheets 1, for example by continuing to drive the separating member 18 in the same sense and to urge the separating member 18 against the transport member 17, while traversing the mechanism back to the position shown in FIG. 4A.

In a further improvement of the second embodiment, a further flexible resilient membrane is wrapped around the separating member 18 in such a way as to support the extracted top sheet 2 as the dispensing mechanism traverses.

Alternative arrangements are readily possible to achieve the same end result. In one alternative, the transport member 17 is capable of vertical motion enabling it to be in continuous contact with, and optionally to control, the rotation of the separating member 18. The separating member 18 is movable vertically with the transport member and the transport member is driven so as to drive the separating member.

Alternatively or additionally, the top sheet 2 to be dispensed is wrapped around the first holding member 15 instead of the second holding member 16, using additional rollers and guides, and is thus dispensed to the left of FIG. 4. The top sheet 2 may also leave the apparatus in a vertical direction or any intermediate angle by the use of appropriately positioned transport rollers or guides.

The Figures and description depict the sheets stacked in a horizontal orientation with the mechanism mounted above it, for illustrative simplicity. It should be understood that alternative orientations are readily possible and are encompassed within the scope of the present invention. The stack of sheets 1 is depicted flat although it may have a degree of curvature if desired. For example, the stack may be curved upwards in the orientation shown in the Figures, so as to promote the separation of the ends of the top sheet 2 from the stack.

The separating members 4 and 18 may be of uniform cross-section across all or part of the width of the media. Alternatively, the second surface 6 may consist of radially discrete areas of high friction on a contiguous surface of lower friction. Several axially discrete rotatable separating members 4, 18 may be mounted on approximately common axes to achieve the same effect.

Although typically the rotation of the separating members 4, 18 is smoothly continuous, the rate of rotation may be varied or interrupted as required to achieve better dynamic performance.

While it is convenient to describe all of the rotating members and cams herein as being circular in cross-section, alternative geometric configurations such as ellipsoids might be substituted. For example, the separating members 4 and 18 may have the form of a cam.

In addition the frictional properties of the second surface 6 may be enhanced by suitable geometric forms such as teeth projecting from the surface. Alternatively cup forms, designed to assist adhesion by generating a slight vacuum when compressed and released, may be used.

Also the friction properties of the second surface 6 may be augmented by electrostatic charge and or surface treatments to make the surface 'tacky' when in contact with the media to be dispensed.

The above embodiments have been described with reference to a stack of cut sheets, which may for example be paper or plastic banknotes, security documents, blank or pre-printed sheets of paper, photographic paper or any other type of sheet having the necessary degree of flexibility. Alternatively, aspects of the invention may be applied to the separation from a surface of the end of a length of flexible material. Furthermore, it will be appreciated that the outer sheet to be dispensed may be the last sheet in a stack, in which case there will be no other sheets adjacent to it.

A number of embodiments of the present invention have been described. Nevertheless, it should be understood that various modifications may be made without departing from the scope of the invention as defined by the following claims.

What is claimed is:

1. Apparatus for separating an outer flexible sheet from a stack of flexible sheets, comprising:

a rotatable separating member arranged to engage the stack with a frictional force which varies as the member rotates, such that the member engages said outer flexible sheet proximate one end thereof and drives said one end towards the center of said outer sheet so as to buckle said outer sheet and separate said one end from the stack, while not engaging any other sheets of said stack during said rotation, wherein the separating member has a first surface having a high coefficient of friction at a first rotational position so as to engage the outer sheet, and a second surface having a low coefficient of friction at a second rotational position so as not to engage the other sheets of said stack.

2. Apparatus as claimed in claim 1, wherein the separating member is arranged to lie between said one end and the stack when said one end is separated from the stack.

3. Apparatus for separating an outer flexible sheet from a stack of flexible sheets, comprising:

first and second transport members arranged to engage and transport a sheet therebetween, such that at least part of the sheet is supported on opposite faces thereof by the first and second transport members;

holding means for holding said outer flexible sheet against said stack; and a separating member, rotatably mounted substantially coaxially with said second transport member, arranged to drive one end of the outer flexible sheet towards the holding means so as to separate a portion of said outer sheet, between said one end and the holding means, from the stack and to separate said lone end of the outer sheet from the stack so that it is engaged and transported from the stack by the first and second transport members wherein said separating member is capable of being drivable independently from the first transport member.

4. Apparatus as claimed in claim 3, wherein the separating member forms part of the second transport member.

5. Apparatus as claimed in claim 3, wherein the first and second transport members are both substantially cylindrical.

6. Apparatus as claimed in claim 3, including means for repeatedly driving the separating member so as to separate a plurality of sheets from the stack, so that the separating member lies between the ends of each of said plurality of sheets and the stack, and means for subsequently moving the separating member to said second position and for transporting said plurality of sheets away from the stack.

7. Apparatus as claimed in claim 3, wherein the separating member and first transport member are moveable between first and second positions, wherein in the first position the separating member is arranged to drive said one end of the outer flexible sheet towards the holding means so as to cause the outer flexible sheet to buckle and said one end to lie between the first and second transport members; and in the second position the first transport member is arranged to grip said one end against the second transport member so as to transport the outer flexible sheet away from the stack.

8. Apparatus as claimed in claim 7, including means for repeatedly driving the separating member in the first position thereof so as to separate a plurality of flexible sheets from the stack, so that their ends lie between the first and second transport members, and means for subsequently moving the first transport member to said second position so as to transport said plurality of flexible sheets away from the stack.

9. Apparatus as claimed in claim 3, wherein the holding means is arranged to contact a portion of the outer flexible sheet with a high frictional force sufficient substantially to prevent movement of the portion during said driving operation, and with a lower frictional force sufficiently small to allow removal of the outer flexible sheet from the stack during the transporting operation.

10. Apparatus as claimed in claim 9, including means for varying the force between said holding means and the stack, so as to very said frictional force.

11. Apparatus as claimed in claim 3, wherein the separating member is arranged to engage the stack with a frictional force which varies as the separating member rotates, such that the separating member engages said outer flexible sheet proximate one end thereof and separates said one end from the stack, while not engaging the other sheets of said stack during said rotation.

12. Apparatus as claimed in claim 11, wherein the separating member has a first surface having a high coefficient of friction at a first rotational position so as to engage the outer flexible sheet, and a second surface having a low coefficient of friction at a second rotational position so as not to engage the other sheets of said stack.

13. Apparatus as claimed in claim 11, wherein the separating member has a first surface at a first rotational position and a second surface at a second rotational position, the first surface having a greater radius from the axis of rotation of the separating member than that of the second surface, so as to promote engagement of the outer flexible sheet by the first surface.

14. Apparatus as claimed in claim 13, including means for holding the stack at a distance from the separating member, such that the second surface does not contact the outer flexible sheet.

15. Apparatus as claimed in claim 3, wherein the separating member is arranged, when said one end of the outer flexible sheet lies between the first and second transport members, subsequently to move towards an opposite end of the outer flexible sheet to said one end so ad to separate an intermediate portion of the outer flexible sheet from the stack.

16. Apparatus as claimed in claim 15, wherein the holding means comprises a holding member moveable with the separating member towards said opposite end.

17. Apparatus as claimed in claim 16, including a resilient flexible member extending from said holding member along the outer flexible sheet towards said opposite end.

18. Apparatus as claimed in claim 17, wherein the holding member is arranged to retract the resilient flexible member as the holding member moves towards said opposite end.

19. Apparatus as claimed in claim 3, wherein said separating member is driveable independently from said first and second transport members.

20. Apparatus as claimed in claim 3, wherein the first transport member is rotatably mounted, and the separating member is rotatably mounted substantially coaxially with the first transport member.

21. A method of separating a plurality of outer flexible sheet from a stack of flexible sheets, comprising:

moving a separating member to a first position adjacent the outer sheet, driving said separating member so as to drive one end of the outer sheet towards the opposite end thereof and to separate said one end of the outer sheet from the stack so that the separating member lies between said one end and the stack, repeating said driving step so as to separate a plurality of said sheets from the stack, moving the separating member to a second position separate from the stack, so as to grip said one end of the plurality of flexible sheets against an opposing surface and transporting the plurality of outer sheets away from the stack.

22. Apparatus for separating an outer flexible sheet from a stack of flexible sheets, comprising:

a separating member arranged to separate one end of the outer sheet from the stack, so that said separating member lies between the outer sheet and the stack, and subsequently to move towards an opposite end of the outer sheet to said one end so as to separate an intermediate portion of the outer sheet from the stack, a holding member for holding a portion of the outer sheet, between said opposite end and the separating member, against the stack, the holding member being moveable with the separating member towards said opposite end, and a resilient flexible member extending from said holding member along the outer sheet towards s/lid opposite end.

23. Apparatus as claimed in claim 22, wherein the holding member is arranged to retract the resilient flexible member as the holding member moves towards said opposite end.

24. Apparatus for separating an outer flexible sheet from a stack of flexible sheets, comprising:

a separating member moveable between first and second positions, wherein in the first position the separating member is arranged to drive one end of the outer sheet towards the opposite end thereof and to separate said one end of the outer sheet from the stack so that the separating member lies between said one end and the stack;

in the second position the separating member is arranged to grip said one end against an opposing surface when the separating member lies between said one end and the stack and to transport the outer sheet away from the stack; and means for repeatedly driving the separating member in the first position thereof so as to separate a plurality of sheets from the stack, so that the separating member lies between the ends of each of said plurality of sheets and the stack, and means for subsequently moving the separating member to said second position and for transporting said plurality of sheets away from the stack.

* * * * *

UNITED STATES PATENT AND TRADEMARK OFFICE

CERTIFICATE OF CORRECTION

PATENT NO. : 6,715,750 B1 
DATED : April 6, 2004
INVENTOR(S) : Roberto Polidoro, Andre Gerlier and David C. Deaville It is certified that error appears in the above-identified patent and that said Letters Patent is hereby corrected as shown below:

Column 9,
Line 43, replace “very” with -- vary --

Column 10,
Line 5, after “so” replace “ad” with -- as --

Signed and Sealed this

Twenty-eighth Day of December, 2004

JON W. DUDAS
*Director of the United States Patent and Trademark Office*